US005360160A

United States Patent [19]

Sauerwine et al.

[11] Patent Number: 5,360,160

[45] Date of Patent: Nov. 1, 1994

[54] ECCENTRIC C-FOLD MAILER WITH A PLURALITY OF REPLY ENVELOPES

[75] Inventors: Dean N. Sauerwine, Zionsville, Pa.; Richard A. Jenkins, Lindenhurst, Ill.

[73] Assignee: Moore Business Forms, Inc., Grand Island, N.Y.

[21] Appl. No.: 84,591

[22] Filed: Jul. 1, 1993

[51] Int. Cl.[5] ..... B65D 27/06; B65D 27/08

[52] U.S. Cl. ..... 229/304; 229/300; 229/305; 229/72

[58] Field of Search ..... 229/300, 301, 303, 304, 229/305, 72, 92.1, 92.3

[56] References Cited

U.S. PATENT DOCUMENTS

| | | | |
|---|---|---|---|
| 3,380,648 | 4/1968 | De Lyra . | |
| 3,784,185 | 1/1974 | Katz | 229/72 X |
| 3,858,792 | 1/1975 | Volkert . | |
| 3,883,069 | 5/1975 | Volkert . | |
| 3,949,935 | 4/1976 | Stackig . | |
| 4,638,940 | 1/1987 | Skokos et al. . | |
| 4,706,877 | 11/1987 | Jenkins . | |
| 4,809,906 | 3/1989 | Lombardo . | |
| 4,852,795 | 8/1989 | Volk, Jr. | 229/72 X |
| 4,896,823 | 1/1990 | Taylor . | |
| 4,928,875 | 5/1990 | Hutchinson . | |
| 4,945,218 | 7/1990 | Talbott . | |
| 4,984,733 | 1/1991 | Dunn, Jr. | 229/301 X |
| 5,201,464 | 4/1994 | File | 229/305 |
| 5,294,041 | 3/1994 | Whiteside | 229/92.1 X |

*Primary Examiner*—Allan N. Shoap
*Assistant Examiner*—Jes F. Pascua
*Attorney, Agent, or Firm*—Nixon & Vanderhye

[57] ABSTRACT

An intermediate, and mailer formed from it, utilize a single sheet to form at least one reply envelope. The sheet is eccentrically C-folded, and preferably two reply envelopes are formed between first and third plies of the mailer. A third reply envelope also can be formed from a second ply of the mailer by a quadrate panel adhesively secured to the bottom face of the second ply. Lines of weakness, such as perforations, allow ready detachment of the sealed edges of the mailer, and separation of the reply envelopes from each other.

30 Claims, 8 Drawing Sheets

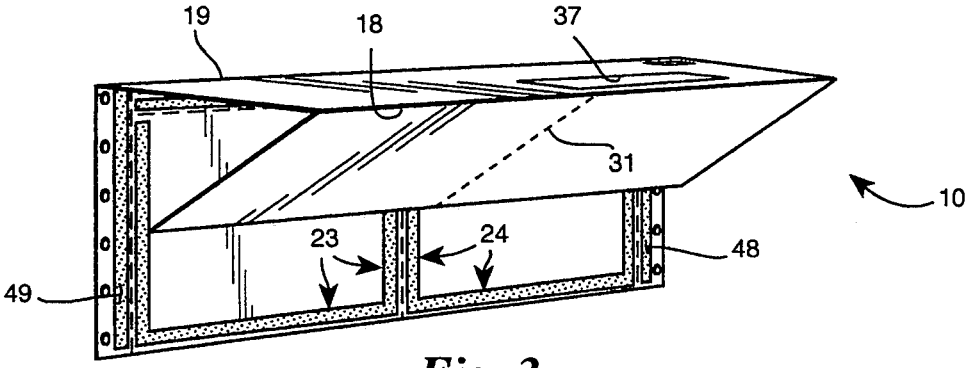
*Fig. 3*
*Fig. 5*
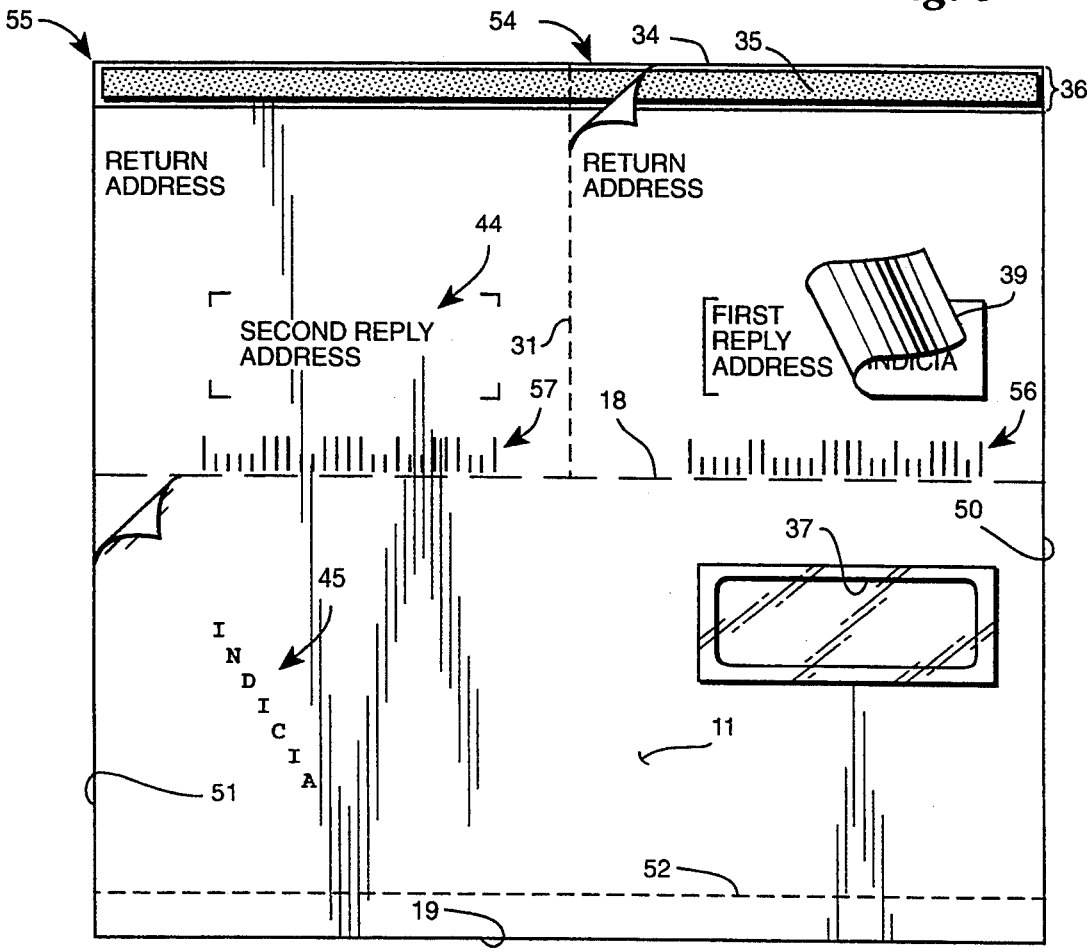

ECCENTRIC C-FOLD MAILER WITH A PLURALITY OF REPLY ENVELOPES

BACKGROUND AND SUMMARY OF THE INVENTION

It is desirable to construct mailer type business forms so that they may be made as simply as possible, yet at the same time contain as much information as possible. Also, it is highly desirable to have a reply envelope with many mailers. There are also a number of circumstances in which it is desirable to have more than one reply envelope to allow the recipient of the mailer to direct his or her response to more than one different reply address, depending upon what the response is. For example, if the mailer relates to a sweepstakes in which the recipient is, or is not, also including an intent to purchase a product along with the sweepstakes entry, at least two different reply addresses are desirable.

According to the present invention a mailer is provided which allows all of the above described goals to be accomplished. The intermediate for forming a mailer according to the invention consists essentially of a single sheet of paper, although a small quadrate ply may be provided to cooperate with the single sheet in order to form a third reply envelope in one embodiment according to the invention. By providing particular adhesive patterns and perforations, when the intermediate is eccentrically C-folded, the mailer according to the present invention is produced.

Three different embodiments are provided according to the present invention. In one embodiment of intermediate, provision is made for two reply envelopes, so that when the intermediate is eccentrically C-folded about fold lines (lines of weakness) the final mailer produced has two different reply envelopes. According to another embodiment of the invention the intermediate is capable of folding to produce three reply envelopes, and by yet another variation of this embodiment four reply envelopes can be provided. According to a third embodiment of the invention, a single, large, reply envelope is provided, and a label with repositional adhesive is provided over the reply address on the reply envelope, and has the outgoing address thereon which is visible through a window in the outgoing mailer.

Thus, according to one aspect of the present invention an intermediate for a mailer type business form is provided. The intermediate comprises: A single sheet of paper having front and back faces, parallel top and bottom edges, and first and second parallel side edges. First and second lines of weakness extending parallel to the top and bottom edges, and defining the sheet into first, second and third panels, the first and second lines of weakness being positioned so that the panel is bordered by the top edge and the first line of weakness, and is smaller than the second and third panels, which are substantially identical in size, the second panel between the first and third panels. First and second patterns of U-shaped adhesive provided on the front face of the third panel with one portion of each U-shaped pattern adjacent the bottom edge, and the patterns adjacent each other. Means defining a reply envelope flap associated with each of the U-shaped patterns in the third panel, and an activatable adhesive strip disposed on the front face of the third panel on the reply envelope flap. A third line of weakness formed in the third panel between the U-shaped patterns of adhesive, perpendicular to the bottom edge, and a continuation of the third line of weakness in the first panel. A window in the second panel on one side of a continuation of the third line of weakness. And an outgoing address area on the front face of the first panel, on one side of the third line of weakness, in alignment with the window when the intermediate is folded about the first line of weakness.

Security screening indicia may be imaged on the back face of the first panel, and on the front face of the third panel between the U-shaped patterns of adhesive, in order to provide an opaque quality to the reply envelopes. A label with repositional adhesive is preferably disposed on the outgoing address area, and first reply address indicia is disposed beneath the repositional adhesive label. Second reply address indicia is disposed on the front face of the first panel on the opposite side of the third line of weakness from the first reply address indicia. The third line of weakness does not extend through the second panel when two reply envelopes are provided, however to provide a third reply envelope, the third line of weakness extends through the second panel and a quadrate panel is adhesively secured along three edges thereof to the front face of the second panel on the opposite side of the third line of weakness from the window, the quadrate panel having third reply address indicia visible thereon.

First and second edge adhesive patterns are disposed on the front face adjacent and parallel to the first and second side edges, respectively, and fourth and fifth lines of weakness extend parallel to and adjacent the first and second edge adhesive patterns on the opposite sides thereof from the first and second side edges, respectively. This allows the intermediate to be eccentrically C-folded about the first and second lines of weakness, and sealed into the final mailer, yet for the mailer to be readily opened. Sixth and seventh lines of weakness are also preferably formed in the third and second panels, respectively, parallel to and slightly spaced from the second line of weakness, to again allow ready opening of the mailer form from the intermediate.

According to another aspect of the present invention an intermediate for a mailer type business form is provided comprising the following elements: A single sheet of paper having front and back faces, parallel top and bottom edges, and first and second parallel side edges. First and second lines of weakness extending parallel to the top and bottom edges, and defining the sheet into first, second and third panels, the first and second lines of weakness being positioned so that the panel is bordered by the top edge and the first line of weakness, and is smaller than the second and third panels, which are substantially identical in size, the second panel between the first and third panels. First and second edge adhesive patterns disposed on the front face adjacent and parallel to the first and second side edges, respectively. Third and fourth lines of weakness adjacent and parallel to the first and second edge adhesive patterns on the opposite sides of the first and second edge adhesive patterns as the first and second side edges. A third adhesive pattern disposed on the front face of the third panel adjacent and parallel to the bottom edge. A strip of activatable adhesive disposed on the third panel front face adjacent, but spaced from, the second fold line and parallel thereto and extending substantially the entire distance from the third to the fourth lines of weakness. A fifth line of weakness disposed in the third panel adjacent the strip of activatable adhesive on the opposite side thereof from the bottom edge. And adhesive means provided on the first or third panels for cooperation with the other of the first or third panels to form at least one reply envelope when the sheet is folded about the first and second lines of weakness.

The adhesive means may comprise means for forming the first and third panels into a single reply envelope, such as a pair of strips of a activatable adhesive disposed on the third panel first face adjacent the third and fourth lines of weakness, such as strips of pressure sensitive adhesive covered by release strips. A window may be formed in the second panel, and an outgoing address area formed on the front face of the first panel positioned with respect to the window so that the intermediate is folded about the first fold line the outgoing address area is visible through the window. Typically a label with repositional adhesive and an outgoing address printed thereon is disposed on the outgoing address area, and reply address indicia is printed on the front face of the first panel underlying the label.

According to yet another aspect of the present invention an intermediate for a mailer type business form is provided comprising the following elements: A single sheet of paper having front and back faces, parallel top and bottom edges, and first and second parallel side edges. First and second lines of weakness extending parallel to the top and bottom edges, and defining the sheet into first, second and third panels, the first and second lines of weakness being positioned so that the panel is bordered by the top edge and the first line of weakness, and is smaller than the second and third panels, which are substantially identical in size, the second panel between the first and third panels. Adhesive means provided on the first or third panels to form at least two reply envelopes when the sheet is folded about the first and second lines of weakness. And at least a third line of weakness for separating the first and third panels until at least two reply envelopes.

The intermediates according to the present invention are each constructed into a mailer type business form. A mailer type business according to the present invention comprises the following elements: First, second and third plies, the first ply sandwiched between the second and third plies, all the plies having the same width, and the second and third plies having a length greater than the length of the first ply; and the plies having top and bottom faces, and first and second side edges. First and second patterns of adhesive cooperating between the first and third plies forming at least two reply envelopes separated by at least a first line of weakness. First and second edge patterns of adhesive disposed adjacent the side edges of the plies for holding the plies together into a mailer. Second and third lines of weakness formed in the plies adjacent and parallel to the first and second edge patterns of adhesive for facilitating opening up the mailer. At least two different reply address indicia provided on the first face of the top face of the first panel, one associated with each of two different reply envelopes. And outgoing address indicia visible when viewing the top face of the second panel.

The first and third plies typically form two reply envelopes, and an interior panel may be adhesively secured to the second ply forming a third reply envelope. A window may be provided in the second ply, the outgoing address indicia provided on the top face of the first ply visible through the window. The outgoing address indicia may be in the form of a label with repositional adhesive, with one of the reply addresses underlying the label. A single flap continuous across the width of the third ply, with rewettable glue or like activatable adhesive thereon, and separated by the first line of weakness, may provide the sealing flaps for the reply envelopes formed from the first and third plies.

According to another aspect of the present invention a mailer type business form comprises the following elements: First, second and third plies, the first ply sandwiched between the second and third plies, all the plies having the same width, and the second and third plies having a length greater than the length of the first ply; and the plies having top and bottom faces, and first and second edges. First and second edge patterns of adhesive disposed adjacent the side edges of the plies for holding the plies together into a mailer. First and second lines of weakness formed in the plies adjacent and parallel to the first and second edge patterns of adhesive for facilitating opening up the mailer. At least one U-shaped pattern of adhesive formed on the front face of the third ply for forming a reply envelope with the first ply. A window formed in the second ply. And a label with repositional adhesive disposed on the top face of the first ply beneath the window and having outgoing address indicia thereon, reply address indicia disposed underneath the label.

It is the primary object of the present invention to provide a simple to construct yet information-rich mailer type business form and intermediate therefor, and preferably one having at least two reply envelopes. This and other objects of the invention will become clear from an inspection of the detailed description of the invention, and from the appended claims.

BRIEF DESCRIPTION OF THE DRAWINGS

FIG. 3 is a top perspective view showing the intermediate of FIGS. 1 and 2 being folded into a first embodiment of a mailer according to the present invention;

FIG. 5 is a top plan view of the mailer of FIG. 4 after it has been opened up by the recipient, illustrating the two return envelopes associated therewith;

DETAILED DESCRIPTION OF THE DRAWINGS

Figure 1:
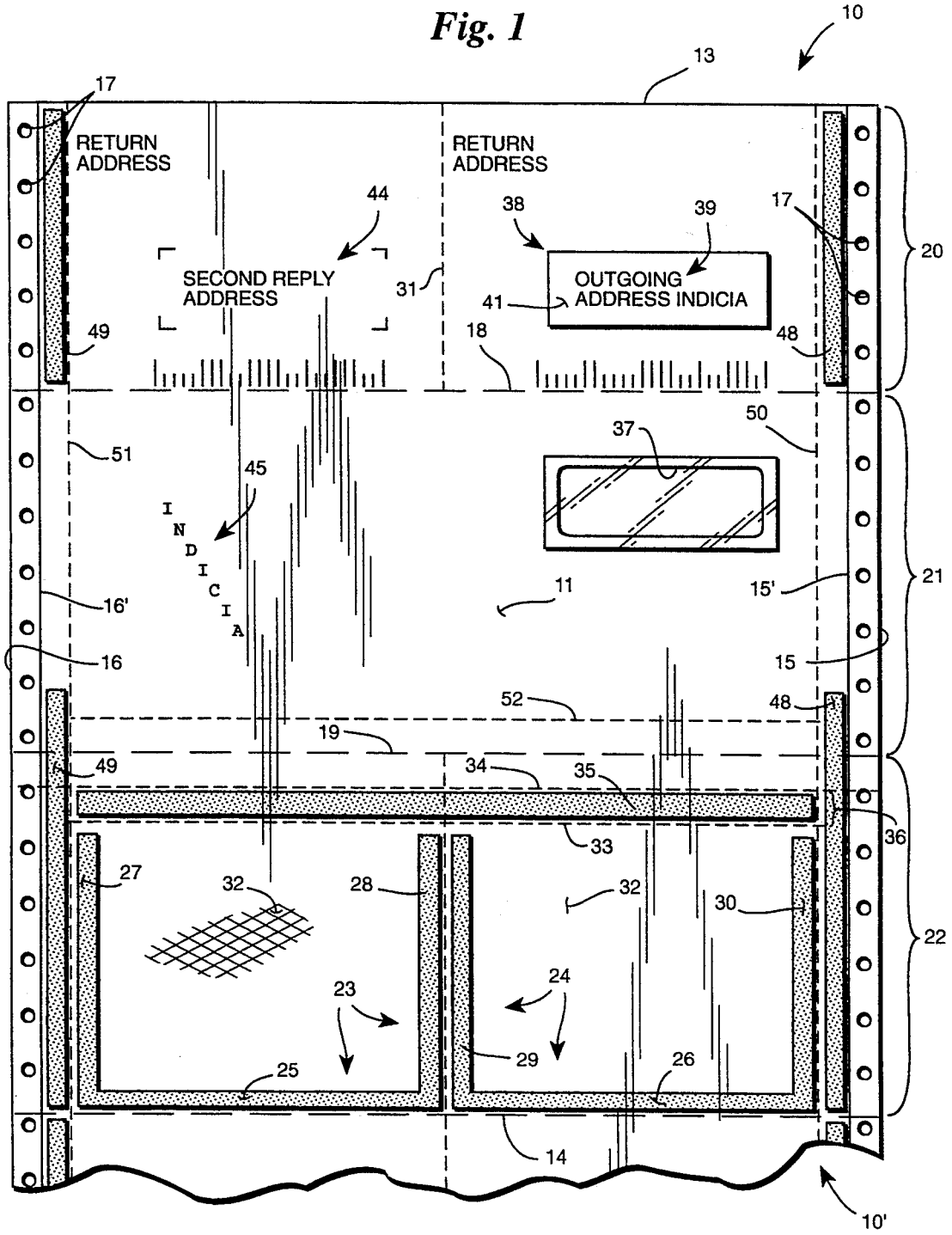
FIG. 1 is a top plan view of a first embodiment of an exemplary intermediate for a mailer type business form according to the present invention.
Figure 2:
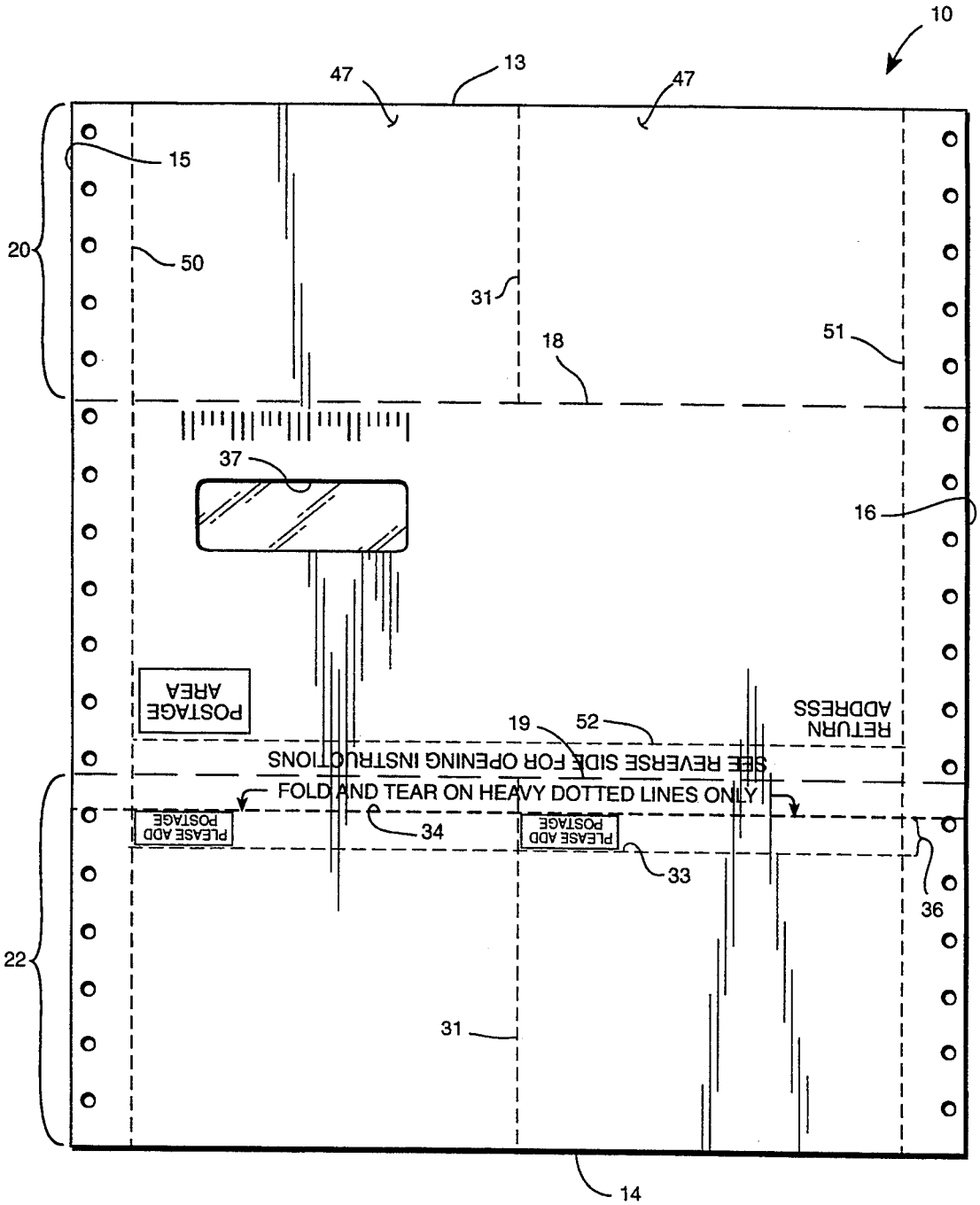
FIG. 2 is a bottom plan view of the intermediate of FIG. 1.

A first embodiment of intermediate according to the present invention is shown generally by reference numeral 10 in FIGS. 1 through 3. It comprises a single sheet of paper having a front face 11 (seen in FIG. 1), and a back face 12 (seen in FIG. 2), with parallel top and bottom edges 13, 14 and first and second parallel side edges 15, 16. While the side edges are shown as the exterior edges in the embodiment illustrated in the drawings, it is to be understood that the strips with the tractor drive openings 17 therein may be cut off, as is conventional, in which case the side edges would be extensions of the portions 15' 16' illustrated in FIG. 1.

Note that the intermediate 10 may be in continuous form, in which case the edges 13, 14 are perforation lines or other lines of weakness, as illustrated schematically for the intermediate 10' shown below the intermediate 10 in FIG. 1. At an appropriate juncture during construction, the continuous form of the intermediates is changed to individual sheets by bursting at the perforation/edges 13, 14.

In the sheet forming the intermediate 10 first and second lines of weakness 18, 19 are provided extending parallel to the edges 13, 14 and defining the sheet into first, second and third panels 20–22, respectively. The lines of weakness 18, 19—which may be score lines, perforations, die cut lines, etc.—are positioned so that the first panel 20 is bordered by the top edge 13 and the first line of weakness 18, and is smaller than the second and third panels 21, 22, the second and third panels 21, 22 being substantially identical in size, and the second panel 21 disposed between the first 20 and third 22 panels.

In the intermediate 10, first and second patterns of U-shaped adhesive, shown generally by reference numerals 23 and 24 in FIG. 1, are provided on the front face 11 of the third panel 22 with one leg portion 25, 26 (respectively, for the patterns 23, 24) adjacent and parallel to the bottom edge 14 in the preferred embodiment illustrated in FIG. 1; the other portions 27, 28, and 29, 30, respectively, of the patterns 23, 24 are disposed so that they are parallel to the side edges 15, 16, and the portions 28, 29 are adjacent each other, separated by a third line of weakness (e.g. perforation) 31. The area within the patterns 23, 24 on the front face 11 may have security screening indicia, shown schematically by reference numeral 32 in FIG. 1.

Means are provided defining a reply envelope flap associated with each of the patterns 23, 24 in the third panel 22. Preferably the flap is formed by the fold or perforation line 33, and the line of weakness 34, which are parallel to but spaced from the second line of weakness 19, and just above the patterns 23, 24. An activatable adhesive strip 35 is provided on the flap 36 formed by the lines 33, 34. As illustrated, for ease of construction, preferably the activatable adhesive strip 35 is provided across the entire width of the panel 22/flap 36 between the far ends of the adhesive strips 27, 30, and the third line of weakness 31 bisects the flap 36.

The third line of weakness 31 preferably includes a continuation portion—seen at the top of FIG. 1—in the panel 20, so that the third line of weakness 31 divides both of the panels 20, 22 (which will meet and cooperate to define two different reply envelopes) into two distinct reply envelopes.

Figure 4:
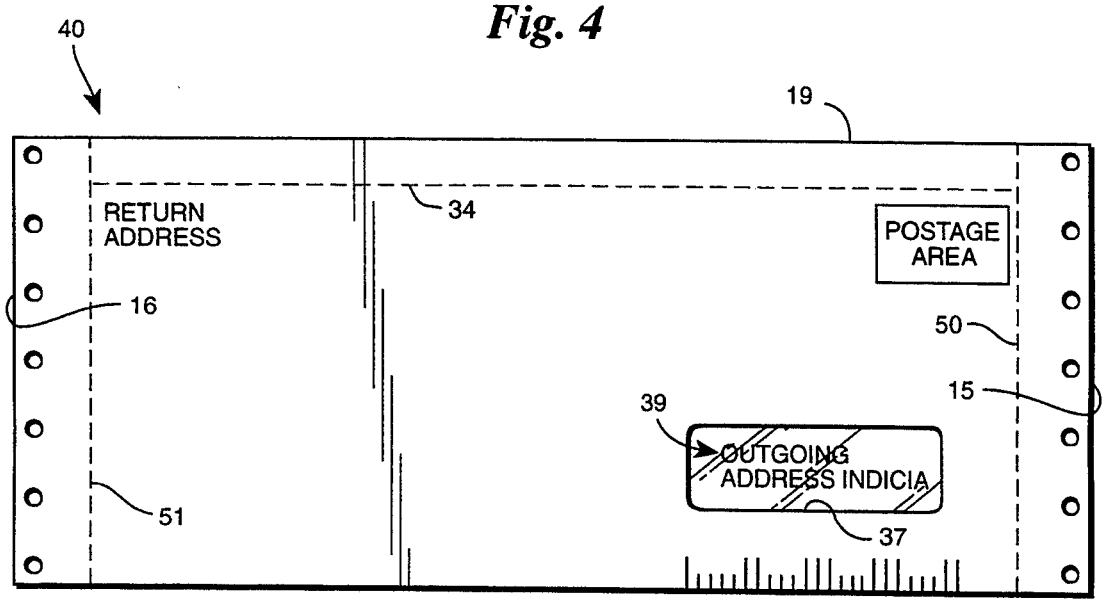
FIG. 4 is a top plan view of the mailer constructed from the intermediate of FIGS. 1 through 3.

In the preferred embodiment illustrated in the drawings, a window 37—which may or may not be covered by a glassine patch—is provided in the second panel 21, positioned with respect to the first line of weakness 18 so that it is generally parallel to but spaced therefrom, and on one side of an imaginary extension between the portions of the third line of weakness 31 (which in this embodiment preferably does not extend through the second panel 21, although it may in order to define a coupon), being to the right of the line of weakness 31 as illustrated in FIG. 1. An outgoing address area 38 is provided on the front face 11 of the first panel 20 on the same side of the line of weakness 31 as the window 37, in alignment with the window 37 when the intermediate 10 is folded about the first line of weakness 18, so that the outgoing address indicia 39 is visible through the window 37 in the final mailer 40—see FIG. 4—that is produced.

As can be seen most clearly in FIG. 5, the outgoing address indicia 39 in the address area 38 preferably is printed on a label 41 which has repositional adhesive 42 on the back thereof. Underlying the label 41 is first reply address indicia 43. On the opposite side of the third line of weakness 31 from the first reply address indicia 43 is the second reply address indicia 44 (see FIGS. 1 and 5).

Note that even though the intermediate 10 is foldable about lines 18, 19—as indicated in FIG. 3—to form the mailer 40 with two reply envelopes, there is still a substantial area for printing of useful information, as indicated by the indicia 45 on the front face 11 of the second panel 21. Indicia could also be printed on the back face 12 of the third panel 22, as long as it did not interfere with delivery of the mailer 40 to the addressee of the outgoing address indicia 39, and as illustrated in FIG. 2 preferably security screening indicia 47 is provided on the back face 12 of the first panel 20.

In order to hold the intermediate 10 in mailer configuration, first and second edge adhesive patterns 48, 49 are preferably provided on the front face 11. The patterns 48, 49 may be discontinuous, as illustrated in FIG. 1, yet still provide an appropriate seal, and if necessary depending upon the particular adhesive used for the patterns 48, 49, the strips 48, 49 may be continuous through the second panel 21, and corresponding strips may be provided on the back face 12 of the first panel 20. Preferably, the adhesive forming the patterns 23, 24, 48, and 49 is conventional heat activated adhesive, although it may also be pressure activated cohesive, such as sold by Tappan Moore of Japan under the trade designation "TM124", or like adhesive. The activatable adhesive 35, on the other hand, is preferably rewettable glue, or pressure sensitive adhesive covered by a release strip.

In order to facilitate opening up of a mailer 40 formed from the intermediate 10, other lines of weakness are preferably provided, such as the lines of weakness 50, 51 which are parallel to the edges 15, 16 and immediately on the opposite side of those edges from the adhesive strips 48, 49 (see FIG. 1). To further facilitate opening up of the mailer 40, another line of weakness 52 is also preferably provided, spaced the same distance from the second line of weakness 19 as the line of weakness 34, and on the opposite side thereof.

In the utilization of the intermediate 10 and the mailer 40 formed therefrom, the intermediate 10 is passed through a suitable printer, in which the reply address indicia 43, 44 and the indicia 45 are printed on the front face 11 thereof. Then the label 41 is applied over the reply address indicia 43, and the intermediate 10 is folded first about the fold line 18 so that the front face 11 of the first panel 20 comes into face to face engagement with the front face 11 of the second panel 21, and then about the second line of weakness 19 so that the first face 11 of the third panel 22 comes into contact with the back face 12 of the first panel 20. Then the intermediate 10 is run through an adhesive sealer (e.g. heat sealer) to seal the portions thereof engaged by the adhesive patterns 23, 24, 48, 49 to form the completed mailer 40, in which the outgoing address indicia 39 is visible through the window 37.

To open up the mailer 40, one detaches along the perforation lines 50, 51 and 34, 52, providing the construction illustrated in FIG. 5. Then by tearing along lines of weakness 18, 31, two different reply envelopes, shown generally by reference numerals 54, 55, are provided, the second reply envelope 55 having the second reply address indicia 44 readily visible thereon, and the first reply address indicia on the first reply envelope 54 being made visible by removing the label 41, with repositional adhesive 42 thereof. If desired, the label 41 may then be applied in the return address area of either of the envelopes 54, 55. Note that the bar coding 56, 57 corresponds to the reply addresses 43, 44 respectively, neither of the bar codes 56, 57 being visible on the mailer 40.

The recipient of the mailer 40 then chooses which of the reply envelopes 54, 55 is appropriate, inserts a check, coupon (which may be part of the second panel 21), or the like into the open top of the envelope 54, 55, and then folds over the flap 36, activating the rewettable glue 35 to seal the reply envelope, and then mails the reply envelope to the reply address 43, 44.

Figure 8:
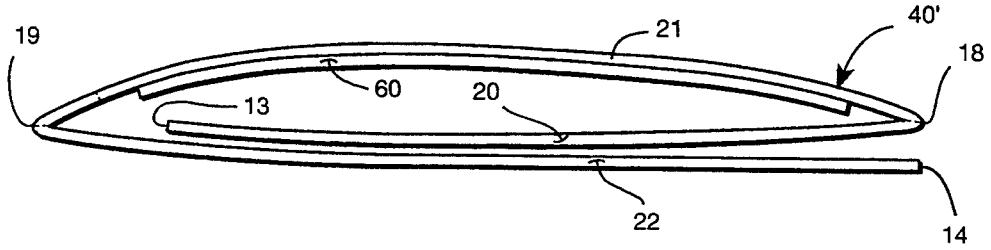
FIG. 8 is a schematic side view showing the components of the intermediate of FIGS. 6 and 7 when folded about the first and second lines of weakness thereof to form a mailer.
Figure 6:
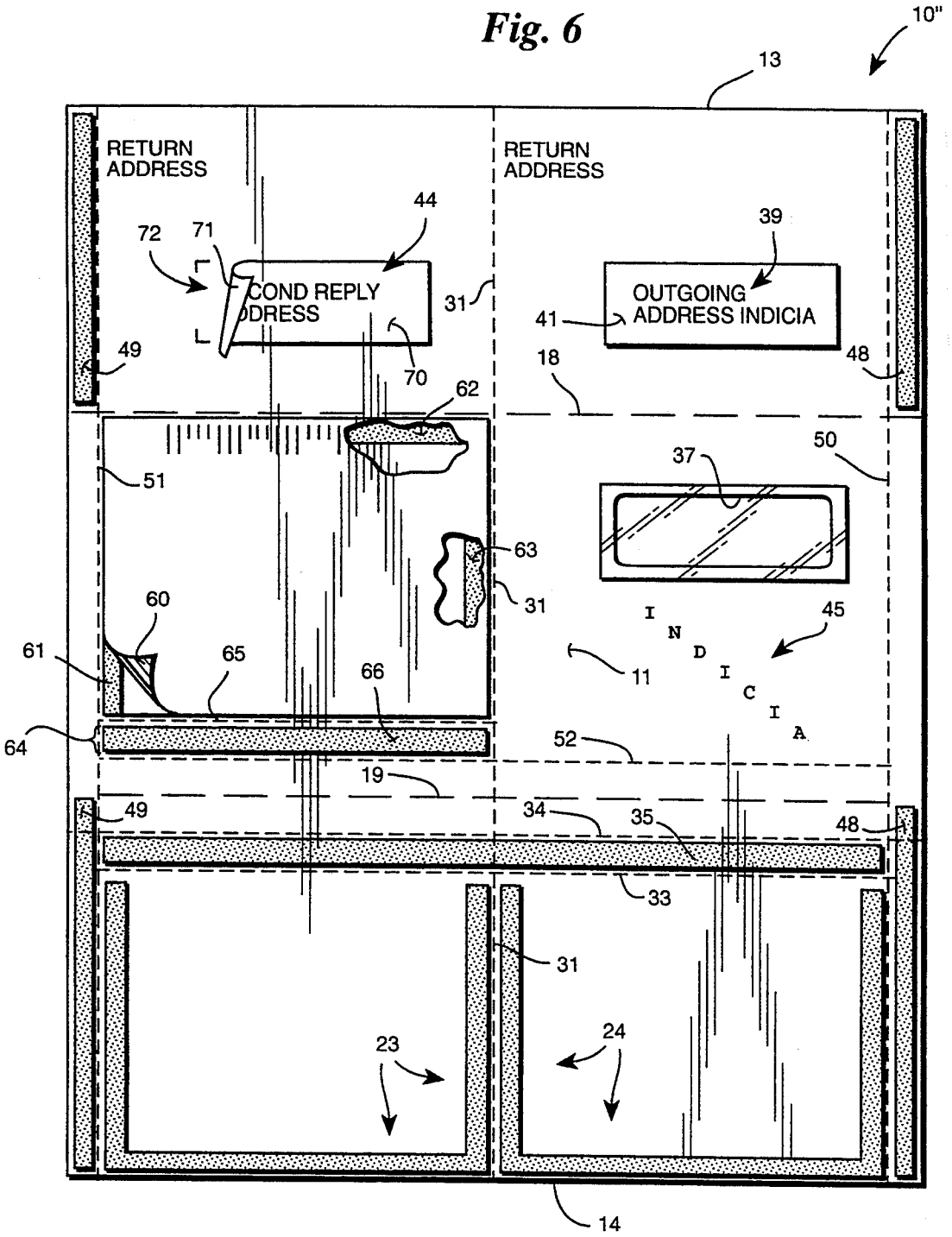
FIG. 6 is a view like that of FIG. 1 for a second embodiment of intermediate according to the present invention, having three reply envelopes.
Figure 7:
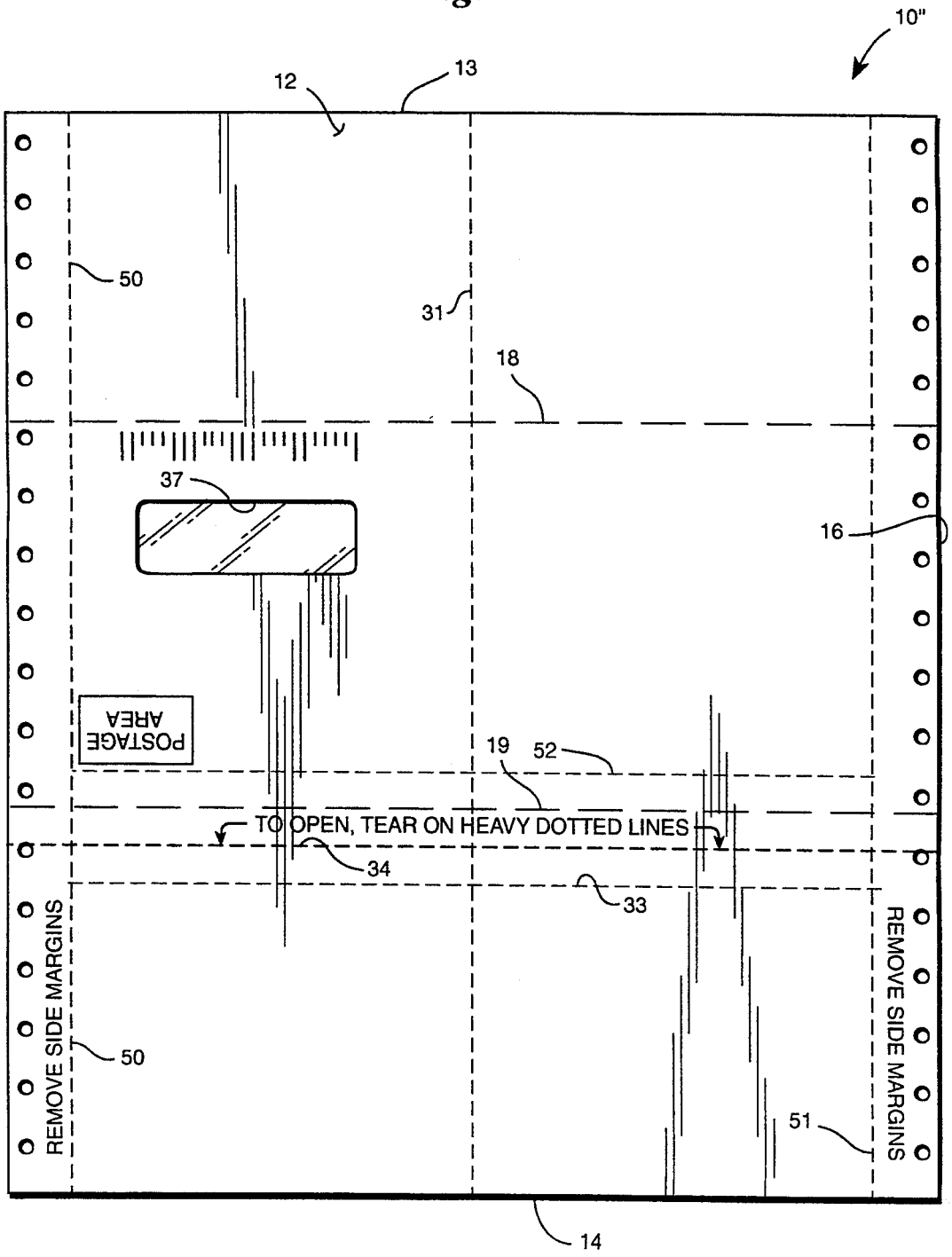
FIG. 7 is a view like that of FIG. 2 for the intermediate of FIG. 6.

In the embodiment illustrated in FIGS. 6 through 8, most of the components are identical to those illustrated in FIGS. 1 through 5 embodiment. These identical components will be shown with the same reference numerals.

The major differences between the FIGS. 6 through 8 and the FIGS. 1 through 5 embodiments are as follows:

In the FIGS. 6 through 8 embodiment, the third reply envelope is formed by the interior quadrate panel 60 being adhesively secured at three sides thereof by the adhesive strips 61, 62, 63 (see FIG. 6) to the second panel 21 on the opposite side of the line of weakness 31 from the window 37. Note that the line of weakness 31 also extends through the second panel 21. In order to define a flap 64 for the third reply envelope, in addition to the line of weakness 52 another fold line or line of weakness 64, is provided. Rewettable glue 66 is provided in a strip on the front face 11 of the second panel 21 on the strip 64. Third reply address indicia 67 is printed on the panel 60.

In order to accommodate the third reply envelope formed by the pane 60 and the left hand portion (as seen in FIG. 6) of the second panel 21, the adhesive strips 48, 49 are discontinued completely in the second panel 21.

The second reply address indicia 44 is provided on a label 70 with repositional adhesive 71 (see FIG. 6) on the back thereof, and covering a fourth reply address shown schematically by reference numeral 72. Thus, with three reply envelopes, four possible reply addresses are provided (or more if a repositional adhesive label similar to the label 70 is provided over the third reply address indicia 67).

Though not illustrated in the drawings, and although less advantageous for running through a printer, according to another embodiment of the invention a panel like the panel 60 may be provided on the right hand side of the second panel 21 as illustrated in FIG. 6, and the window 37 done away with, and the outgoing address indicia imaged on the back face 12 of the second panel 21 where the window 37 is.

The intermediate 10'' of FIGS. 6 and 7 is constructed and utilized just like the intermediate 10 except that normally the adhesive 61, 63 is secured in place before folding about the fold lines 18, 19, and when the mailer 40' (see FIG. 8) is opened up, detachment along the line of weakness 31 also takes place through the pane 21.

Figure 9:
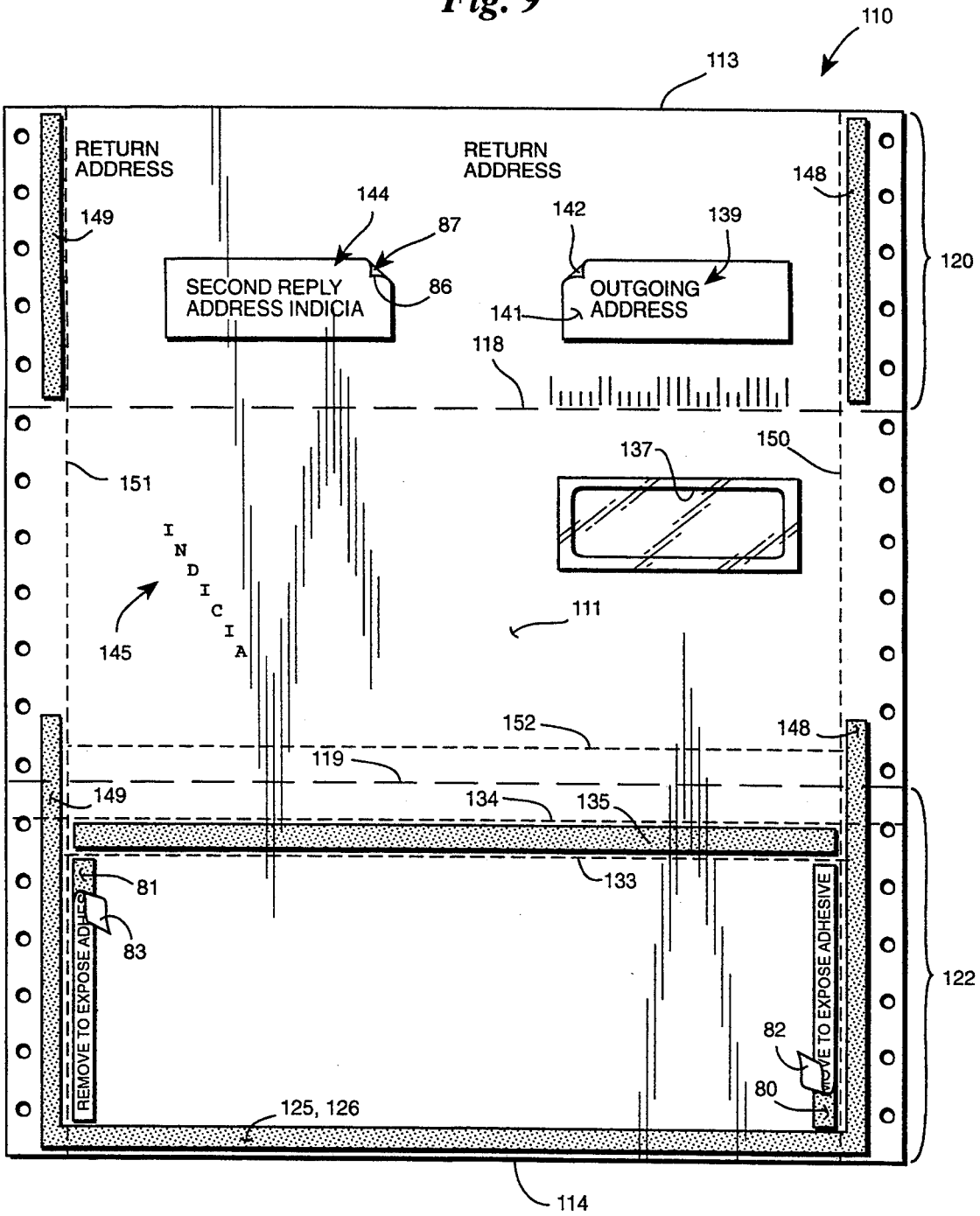
FIG. 9 is a view like that of FIG. 1 for a third embodiment of intermediate according to the invention.
Figure 10:
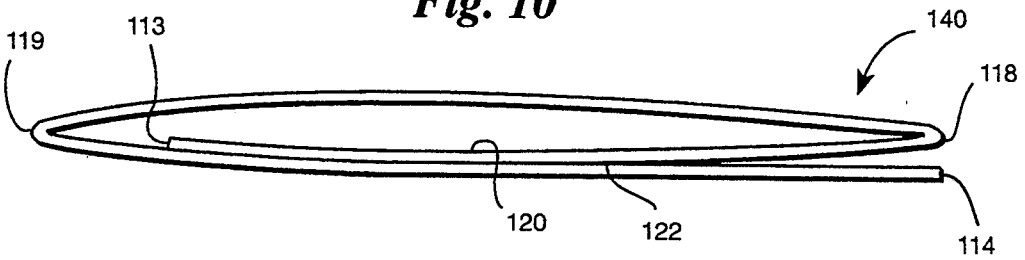
FIG. 10 is a schematic side view of the intermediate of FIG. 9 shown folded about the lines of weakness thereof to produce a mailer.
Figure 11:
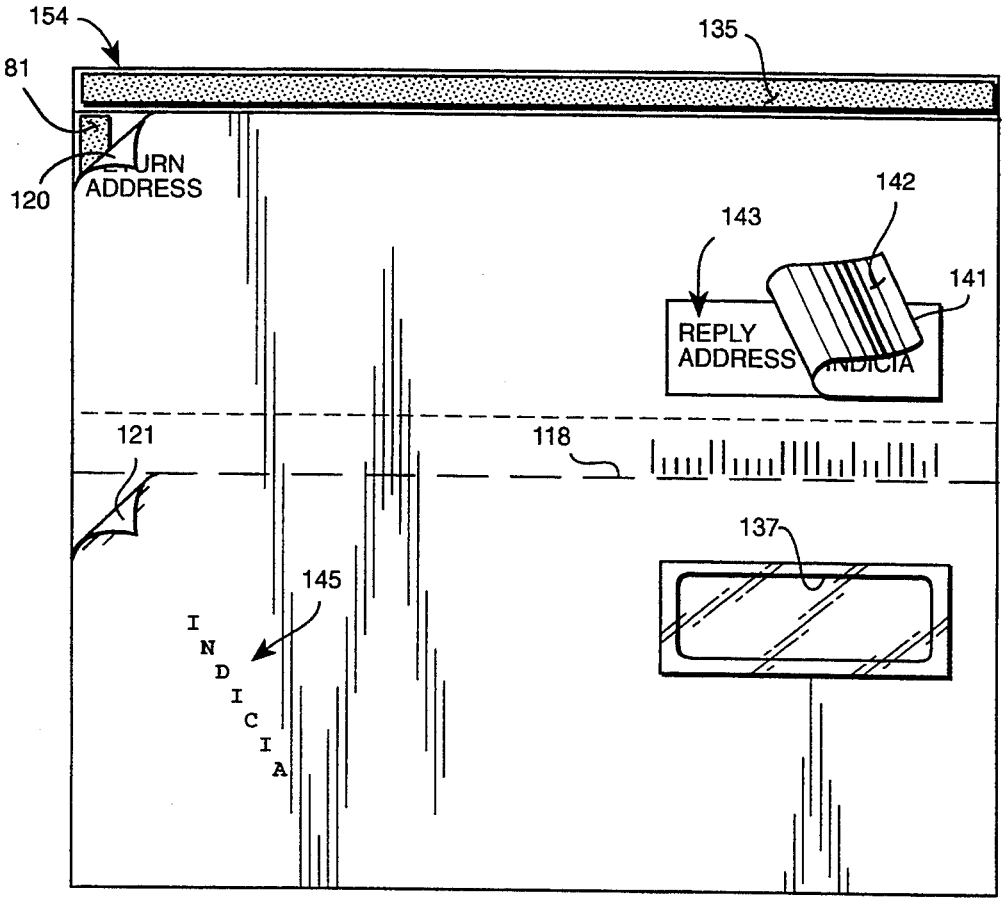
FIG. 11 is a view like that of FIG. 5 only showing the mailer of FIG. 10 once opened.

A third embodiment according to the invention is shown in FIGS. 9 through 11. In this embodiment components comparable to those in the FIGS. 1 through 5 embodiment are shown by the same reference numeral only preceded by a "1". Therefore, all these components will not be described individually, but rather attention is directed to the FIGS. 1 through 5 embodiment for a description thereof. The major differences in this embodiment and the FIGS. 1 through 5 embodiment are as follows:

A single reply envelope 154 is provided, there being no line of weakness 31 extending along the length of and through the middle of the intermediate 110.

The single reply envelope 154 that is formed is not formed originally when the intermediate 110 is folded about the fold lines 118, 119 to produce the mailer 140 (FIG. 10). Rather, the adhesive that forms the sides of the reply envelope 154 is formed by strips of activatable adhesive which—in the preferred embodiment illustrated in FIGS. 9 through 11—are pressure sensitive adhesive strips 80, 81 extending adjacent the perforation lines 150, 151 in the third panel 122, and covered by release material strips 82, 83. Because the reply envelope 154 is not automatically formed, additional indicia 85 may be provided on the front face 111 of the third panel 122 instead of security screening, thus transmitting much more information to the recipient of the mailer.

In order to allow the recipient to still send the reply envelope 154 to more than one different reply address, a second label 86, with repositional adhesive 87 thereon (see FIG. 9), and with the second reply address indicia 144, may be provided on the panel 120 first face 111, and readily removable therefrom and placable over the outgoing address label 141, or preferably over the first reply address indicia 143 after the label 141 has been removed.

Except for the changes necessary to form the reply envelope 154 by removing the strips 82, 83 the manufacture and utilization of the intermediate 110 and mailer 140 of the FIGS. 9 through 11 embodiment are the same as for the FIGS. 1 through 5 embodiment.

It will thus be seen that according to the present invention an advantageous intermediate and mailer have been provided according to the invention. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as encompass all equivalent structures and products.

What is claimed is:

1. An intermediate for a mailer type business form comprising:

a single sheet of paper having front and back faces, parallel top and bottom edges, and first and second parallel side edges;

first and second lines of weakness extending parallel to said top and bottom edges, and defining the sheet into first, second and third panels, said first and second lines of weakness being positioned so that said panel is bordered by said top edge and said first line of weakness, and is smaller than said second and third panels, which are substantially identical in size, said second panel between said first and third panels;

first and second patterns of U-shaped adhesive provided on said front face of said third panel with one portion of each U-shaped pattern adjacent said bottom edge, said patterns adjacent each other;

means defining a reply envelope flap associated with each of said U-shaped patterns in said third panel, and an activatable adhesive strip disposed on said front face of said third panel on said reply envelope flap;

a third line of weakness formed in said third panel between said U-shaped patterns of adhesive, perpendicular to said bottom edge, and a continuation of said third line of weakness in said first panel a window in said second panel on one side of a continuation of said third line of weakness; and an outgoing address area on said front face of said first panel, on one side of said third line of weakness, in alignment with said window when said intermediate is folded about said first line of weakness.

2. An intermediate as recited in claim 1 further comprising a label with repositional adhesive disposed on said outgoing address area, and first reply address indicia disposed beneath said repositional adhesive label.

3. An intermediate as recited in claim 2 further comprising second reply address indicia disposed on said front face of said first panel on the opposite side of said third line of weakness from said first reply address indicia.

4. An intermediate as recited in claim 3 wherein said third line of weakness extends through said second panel, and further comprising a third reply envelope forming quadrate panel adhesively secured along three edges thereof to said front face of said second panel on the opposite side of said third line of weakness from said window, said quadrate panel having third reply address indicia visible thereon.

5. An intermediate as recited in claim 4 further comprising first and second edge adhesive patterns disposed on said front face adjacent and parallel to said first and second side edges, respectively, and fourth and fifth lines of weakness extending parallel to and adjacent said first and second edge adhesive patterns on the opposite sides thereof from said first and second side edges, respectively.

6. An intermediate as recited in claim 5 further comprising sixth and seventh lines of weakness formed in said third and second panels, respectively, parallel to and slightly spaced from said second line of weakness.

7. An intermediate as recited in claim 1 further comprising security screening indicia imaged on said back face of said first panel.

8. An intermediate as recited in claim 7 further comprising security screening indicia imaged on said front face of said-third panel between said U-shaped patterns of adhesive.

9. An intermediate as recited in claim 1 wherein said third line of weakness extends through said second panel, and further comprising a third reply envelope forming quadrate panel adhesively secured along three edges thereof to said front face of said second panel on the opposite side of said third line of weakness from said window.

10. An intermediate as recited in claim 1 further comprising first and second edge adhesive patterns disposed on said front face adjacent and parallel to said first and second side edges, respectively, and fourth and fifth lines of weakness extending parallel to and adjacent said first and second edge adhesive patterns on the opposite sides thereof from said first and second side edges, respectively.

11. An intermediate as recited in claim 1 further comprising sixth and seventh lines of weakness formed in said third and second panels, respectively, parallel to and slightly spaced from said second line of weakness.

12. An intermediate for a mailer type business form comprising:

a single sheet of paper having front and back faces, parallel top and bottom edges, and first and second parallel side edges;

first and second lines of weakness extending parallel to said top and bottom edges, and defining the sheet into first, second and third panels, said first and second lines of weakness being positioned so that said first panel is bordered by said top edge and said first line of weakness, and is smaller than said second and third panels, which are substantially identical in size, said second panel between said first and third panels;

first and second edge adhesive patterns disposed on said front face adjacent and parallel to said first and second side edges, respectively;

third and fourth lines of weakness adjacent and parallel to said first and second edge adhesive patterns on the opposite sides of said first and second edge adhesive patterns as said first and second side edges;

a third adhesive pattern disposed on said front face of said third panel adjacent and parallel to said bottom edge;

a strip of activatable adhesive disposed on said third panel front face adjacent, and spaced from, said second fold line and parallel thereto and extending substantially the entire distance from said third to said fourth lines of weakness;

a fifth line of weakness disposed in said third panel adjacent said strip of activatable adhesive on the opposite side thereof from said bottom edge; and adhesive provided on one of said first and third panels for cooperation with the other of said first and third panels to form at least one reply envelope when said sheet is folded about said first and second lines of weakness.

13. An intermediate as recited in claim 12 wherein said adhesive means comprises means for forming said first and third panels into a single reply envelope.

14. An intermediate as recited in claim 13 wherein said adhesive means comprises a pair of strips activatable adhesive disposed on said third panel first face adjacent said third and fourth lines of weakness.

15. An intermediate as recited in claim 12 further comprising a window formed in said second panel, an outgoing address area formed on said front face of said first panel positioned with respect to said window so that when said intermediate is folded about said first fold line said outgoing address area is visible through said window.

16. An intermediate as recited in claim 15 further comprising a label with repositional adhesive and an outgoing address printed thereon disposed on said outgoing address area, and reply address indicia on said front face of said first panel underlying said label.

17. An intermediate as recited in claim 16 wherein said label with repositional adhesive comprises a first label, and further comprising a second label with repositional adhesive and a second reply address printed thereon, said second label disposed on said front face of said first or third panel and having substantially the same dimensions as said first label.

18. An intermediate as recited in claim 12 wherein said adhesive means comprises means for forming said first and third panels into two reply envelopes, separated by a sixth line of weakness extending parallel to said side edges.

19. An intermediate as recited in claim 18 further comprising a window formed in said second panel, an outgoing address area formed on said front face of said first panel positioned with respect to said window so that when said intermediate is folded about said first fold line said outgoing address area is visible through said window.

20. An intermediate as recited in claim 19 further comprising a label with repositional adhesive and an outgoing address printed thereon disposed on said outgoing address area, and a first reply address indicia on said front face of said first panel underlying said label, second reply address indicia disposed on said front face of said first panel on the opposite side of said sixth line of weakness from said first reply address indicia.

21. An intermediate for a mailer type business form comprising:

a single sheet of paper having front and back faces, parallel top and bottom edges, and first and second parallel side edges;

first and second lines of weakness extending parallel to said top and bottom edges, and defining the sheet into first, second and third panels, said first and second lines of weakness being positioned so that said panel is bordered by said top edge and said first line of weakness, and is smaller than said second and third panels, which are substantially identical in size, said second panel between said first and third panels;

adhesive provided on one of said first and third panels to form at least two reply envelopes when said sheet is folded about said first and second lines of weakness; and at least a third line of weakness for separating said first and third panels into at least two reply envelopes.

22. A mailer type business form, comprising:

first, second and third plies, said first ply sandwiched between said second and third plies, all said plies having the same width, and said second and third plies having a length greater than the length of said first ply; and said plies having top and bottom faces, and first and second side edges;

first and second patterns of adhesive cooperating between said first and third plies forming at least two reply envelopes separated by at least a first line of weakness;

first and second edge patterns of adhesive disposed adjacent said side edges of said plies for holding said plies together into a mailer;

second and third lines of weakness formed in said plies adjacent and parallel to said first and second edge patterns of adhesive for facilitating opening up said mailer;

at least two different reply address indicia provided on said first face of said top face of said first ply, one associated with each of two different reply envelopes;

outgoing address indicia visible when viewing said top face of said second ply; and said second ply has a window therein, and wherein said outgoing address indicia visible when viewing said top face of said second ply is provided on said top face of said first ply.

23. A mailer as recited in claim 22 wherein said first and third plies form two reply envelopes; and further comprising an interior panel adhesively secured to said second ply forming a third reply envelope.

24. A mailer as recited in claim 21 wherein said outgoing address indicia is provided on a label with repositional adhesive disposed on said top face of said first ply, and wherein said first reply address indicia disposed beneath said repositional adhesive label.

25. A mailer as recited in claim 24 further comprising fourth and fifth lines of weakness formed in said first and third plies, said first and second reply address indicia on the opposite sides of said fourth and fifth lines of weakness.

26. A mailer as recited in claim 25 wherein said first and third plies form two reply envelopes; and further comprising an interior panel adhesively secured to said second ply forming a third reply envelope.

27. A mailer as recited in claim 26 wherein said two reply envelopes formed from said first and third plies have a common reply envelope flap with activatable adhesive disposed on said top face of said third ply.

28. A mailer type business form comprising:

first, second and third plies, said first ply sandwiched between said second and third plies, all said plies having the same width, and said second and third plies having a length greater than the length of said first ply; and said plies having top and bottom faces, and first and second side edges;

first and second edge patterns of adhesive disposed adjacent said side edges of said plies for holding said plies together into a mailer;

first and second lines of weakness formed in said plies adjacent and parallel to said first and second edge patterns of adhesive for facilitating opening up said mailer;

at least one U-shaped pattern of adhesive formed on the front face of said third ply for forming a reply envelope with said first ply;

a window formed in said second ply; and a label with repositional adhesive disposed on said top face of said first ply beneath said window and having outgoing address indicia thereon, reply address indicia disposed underneath said said label; and further comprising a second repositional adhesive label having a second reply address printed thereon provided on the top face of one of said first and third plies having approximately the same dimensions as the first repositional adhesive label.

29. A mailer as recited in claim 28 wherein said at least one U-shaped pattern of adhesive comprises a single U-shaped pattern, having a base portion of heat seal glue disposed adjacent an edge of said third ply, and having activatable adhesive strips disposed adjacent, and spaced from, said side edges of said third ply.

30. A mailer as recited in claim 29 wherein said strips of activatable adhesive are pressure sensitive adhesive covered by release paper.

* * * * *